United States Patent [19]

Habib et al.

[11] 4,346,663

[45] Aug. 31, 1982

[54] ANCHORING SYSTEM

[75] Inventors: Pierre Habib, Paris; Minh P. Luong, Montgeron, both of France

[73] Assignee: Institut Francais du Petrole, Rueil-Malmaison, France

[21] Appl. No.: 186,026

[22] PCT Filed: Apr. 27, 1979

[86] PCT No.: PCT/FR79/00038

§ 371 Date: Jan. 2, 1980

§ 102(e) Date: Jan. 2, 1980

[87] PCT Pub. No.: WO79/01017

PCT Pub. Date: Nov. 29, 1979

[30] Foreign Application Priority Data

May 2, 1978 [FR] France ..... 78 13299

[51] Int. Cl.[3] ..... B63B 21/26

[52] U.S. Cl. ..... 114/295; 114/301

[58] Field of Search ..... 114/301, 294, 295, 311

[56] References Cited

U.S. PATENT DOCUMENTS

| | | | |
|---|---|---|---|
| 305,186 | 9/1884 | Herman | 114/301 |
| 1,838,745 | 12/1931 | Croney | 114/294 |
| 2,721,530 | 10/1955 | Vorenkamp | 114/294 |
| 2,735,394 | 2/1956 | Walpole | 114/294 |
| 3,305,984 | 2/1967 | Borcuk | 114/301 X |
| 3,570,440 | 3/1971 | Pot | 114/301 |
| 3,685,479 | 8/1972 | Bruce | 114/294 |
| 3,961,451 | 6/1976 | McCain | 114/301 X |
| 4,173,938 | 11/1979 | Colin | 114/301 |

FOREIGN PATENT DOCUMENTS

| | | | |
|---|---|---|---|
| 1562678 | 2/1969 | France | 114/294 |
| 15711 | of 1891 | United Kingdom | 114/301 |

*Primary Examiner*—Trygve M. Blix
*Assistant Examiner*—Stephen P. Avila
*Attorney, Agent, or Firm*—Millen & White

[57] ABSTRACT

An anchoring system wherein the anchor comprises a plate. An anchor line is connected to the plate by a flexible connection located ahead of the center of mass of the bearing surface of the plate in the direction of displacement thereof when being positioned. The plate is further adapted for facilitating penetration into the ground whereby the entire anchor penetrates into the ground.

11 Claims, 17 Drawing Figures

FIG.5A
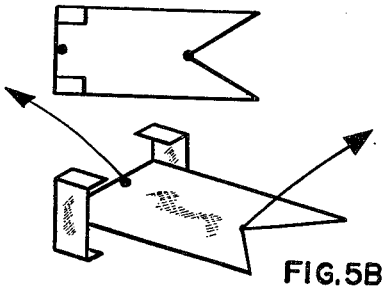
FIG.5B
FIG.6A
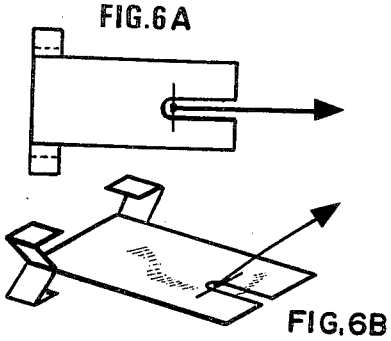
FIG.6B
FIG.7A
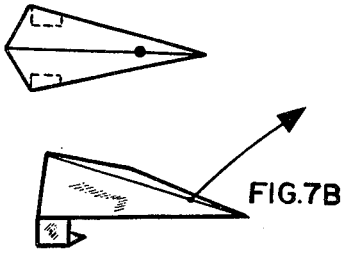
FIG.7B
FIG.8A
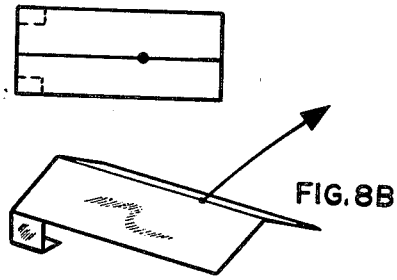
FIG.8B
FIG.9A
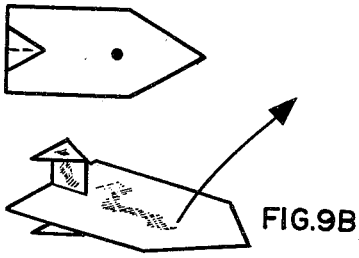
FIG.9B
FIG.10A
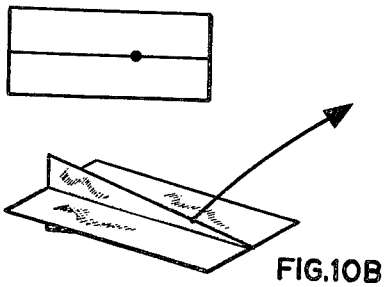
FIG.10B

ANCHORING SYSTEM

BACKGROUND OF THE INVENTION

The present invention relates to a new anchoring system.

The anchoring system according to the invention is in particular, suitable for securing in position floating structures such as chips, offshore drilling and hydrocarbon production platforms, etc. This anchoring system is also suitable for anchoring structures on land.

Conventional anchoring system of positioning a plate, or hook in the ground, to which a horizontal pull is subsequently applied by means of a rigid rod or shank connected to a chain by means of an eyelet.

The weight of this anchor is high so as to permit the initial penetration of the flukes or hooks into the ground, this penetration being only slight when the anchor is just laid onto the ground and subsequently increasing as the anchor is dragged. Ahead of the buried fluke of the anchor, the ground acts as an abutment and a wedge similar to the Coulomb's wedge is formed: the anchor and the ground wedge would have a tendency to glide upwardly in the absence of the anchor weight which maintains the anchor fluke or flukes buried at a certain depth, thus providing for a kinematic equilibrium, so that it is often assumed that the holding power of an anchor, (i.e. the highest admissible horizontal pull F), is proportional to the anchor weight P. Depending on the anchor shape, the ratio (F/P) comprises a value of between 5 and 15 for a sandy water bottom, and between 8 and 20 for a clayish bottom.

Thus high capacity anchors are very heavy, weighing up to 10 or 15 tons.

An additional requirement is that the anchor must always be positioned correctly for gripping the ground when it is laid, irrespective of the configuration of the water bottom. This has lead to anchor shapes generally having two planes of symmetry, such as the very conventional and well known grapnel type anchor or anchors having hinged mechanisms allowing pivoting about a shaft at the end of the anchor shank and perpendicular thereto, such mechanisms providing for symmetrical positions of the anchor.

Moreover, since the anchor must be weighed at the end of the mooring period, additional devices are sometimes used to facilitate this operation.

SUMMARY OF THE INVENTION

An object of the invention is to provide an anchor of substantially reduced size and weight as compared to the conventional anchors of the same holding power.

Another object of the invention is to provide an anchor which can be more easily placed in position.

French Pat. No. 1,562,678 already discloses an anchor comprising a curved plate having a plane of symmetry with a circular arc cross-section, as well as the same type of cross-section along planes parallel thereto. A suitably adapted device permits connection of this plate to a chain or to an anchor cable, with the connecting device located in the plane of symmetry of the plate and secured thereto so that the anchor chain or cable exerts at its connection point, a pull directed outwardly from the convex side of the plate.

This connecting device is preferably positioned at the center of gravity of the plate, or in the vicinity thereof.

However such an anchor suffers from the drawback of penetrating into the ground along a circular path, the average inclination of the plate, relative to the horizontal, increasing progressively as this plate is buried more deeply.

This characteristic is detrimental to the stability of the anchor because it prevents the latter from being buried very deeply, any reduction in the burying depth tending to facilitate the release of the plate from the ground.

U.S. Pat. No. 2,721,530 describes an anchor comprising a plate to which the anchor line is secured by means of chains connected to a plurality of points of the plate, and connected to the anchor line through a ring. Such an anchor is capable of penetrating only into soft muddy soils.

The invention provides an anchoring system which is free of the above-mentioned drawbacks.

The anchoring system according to the invention comprises an anchor including at least one plate, at least one anchor line connected to at least one point of said plate, through a flexible connection which does not substantially introduce any moment of rotation at the connection point, the point of application of a traction force to said plate being stationary and located ahead of the center of mass of the bearing surface of said plate, in the direction of displacement of the plate through the ground during its positioning. The anchor further comprises means for facilitating the penetration of said plate into the ground by applying a simple pull to the line, said means combining a sufficient weight of the anchor with means adapted for maintaining the leading edge of the anchor inclined to the ground at an angle of at most 30°.

By flexible connection means is meant a connection which does not introduce any substantial moment of rotation at the connection point of the plate. The means can include devices such as a connecting wire, chain, ball-and-socket joint or a hinged rod which can rotate substantially over 360° about an axis perpendicular to the longitudinal of plane symmetry of the plate.

The weight of the anchor must be sufficient to prevent it, before complete burying thereof, from pivoting or tilting forward about its leading edge or an axis close thereto, under the action of the pull exerted on the anchor line.

The minimum weight of the anchor avoiding this drawback depends on the type of ground and will be higher the firmer the ground.

Moreover the anchor line should be given the minimum crosssection compatible having a sufficient strength to resist traction applied thereto, so as to facilitate the burying of the anchor into the ground.

This burying may optionally be aided by ramming or driving.

BRIEF DESCRIPTION OF THE DRAWINGS

Examples of embodiments of the invention are illustrated by the accompanying drawings, wherein:

FIG. 5A is a top plan view of another embodiment of the anchor of the invention having a v-shaped notch cut-out in the front to define a split sharp leading edge, FIG. 5B is a perspective view of the anchor of FIG. 5A, FIG. 6A is a top plan view of a dual leading edge anchor as in FIG. 5A with the leading edges square, FIG. 6B is a perspective view of the anchor of FIG. 6A, FIG. 7A is a top plan view of a bent arrow shaped embodiment of the invention, FIG. 7B is a perspective view of the anchor of FIG. 7A, FIG. 8A is an embodiment of the invention showing a top plan view of a bent rectangle shaped anchor, FIG. 8B is a perspective view of the anchor of FIG. 8A, FIG. 9A is a top plan view of another embodiment of the invention with the main plate having a shape similar to that of FIG. 1, FIG. 9B is a perspective view of the anchor of FIG. 9A, FIG. 10A is a top plan view of a rectangular plate shaped anchor according to still another embodiment of the invention, and FIG. 10B is a perspective view of the anchor of FIG. 10A.

DETAILED DISCUSSION OF THE INVENTION

Figure 1:
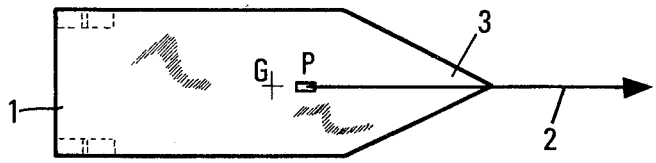
FIG. 1 is a diagrammatic top view of a first embodiment of an anchor according to the invention.
Figure 2:
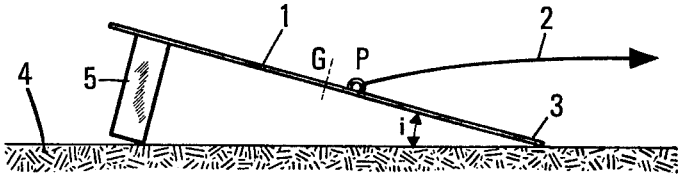
FIG. 2 is a side view of the anchor of FIGS. 1 and 1A lying on the water bottom at the beginning of its positioning, FIGS. 3 and 4 diagrammatically sequentially illustrate the displacement of the anchor through the ground during its positioning.

FIGS. 1 and 2 show an anchoring system according to the invention laying on the water bottom before its positioning, this system comprising a plate 1 to which an anchor line, such as a chain or cable is connected.

In this device the connection between the plate and the anchoring line is a flexible connection, i.e. excluding an intermediary such as a rod rigidly secured to the plate.

Moreover, the point P of connection of the anchor line to the plate is located ahead of the center of mass G of the bearing surface of the plate towards the leading edge 3 of this plate, is the direction of displacement of the latter through the ground 4 during the step of positioning the plate.

Furthermore, means such as the legs 5, as shown in FIG. 2, facilitate penetration of the anchor into the ground by giving its leading edge 3 an initial inclination towards the ground. The value of the angle of inclination i, relative to the horizontal, does not exceed 30°.

Figure 3:
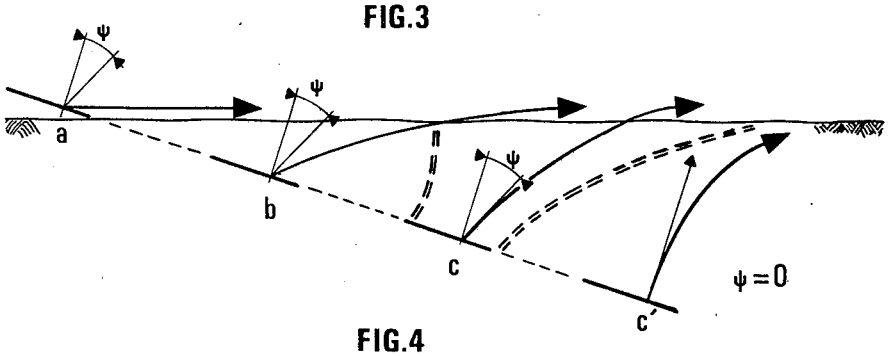

This new anchor is adapted for operation and movement underground in much the same manner as that of a glider. Anchoring is achieved by progressively burying a plate or form, which slides through the ground under the action of the pull applied by the chain. This traction force can be resolved, along the direction of the displacement and perpendicular to the mean plane of the anchor, into two components which develop at the level of the anchor, and of the ground, into a normal force n and a tangential force t. The anchor continues to slide and becomes progressively buried as long as $$t \geqq c + n \tan\Psi,$$

wherein c and Ψ are respectively, the adhesion coefficient and the friction coefficient of the ground on the anchor. At this time, the holding power is the result of the anchor's lateral friction on the ground. When the above inequality becomes no longer fulfilled, the system is blocked i.e., the anchor's position is fixed and the tearing out of the anchor requires the tearing out of a ground volume having substantially the shape of an inclined reversed cone, as shown in FIG. 3.

Figure 1A:
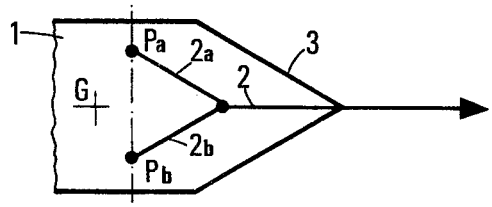
FIG. 1A is a modification of the embodiment illustrated in FIG. 1.

FIG. 1A shows an embodiment wherein the anchor line 2 is divided in the vicinity of the plate 3, into two branches 2*a* and 2*b* having respective connecting points Pa and Pb to the plate 3. The connecting points Pa and Pb are both located ahead of the center of mass G, as in the above-described embodiment.

The path followed by the anchor in the ground depends on the following factors:

- its initial position on the ground: the mean plane of the anchor is inclined towards the ground surface by a carefully determined angle i which varies with the anchor shape, but is generally about from 15° to 25°;
- the position of the connecting point of the anchor line;
- the maximum cross-section of this anchor line, which imparts to the path a certain catenary configuration in the ground; it is this shape which determines the angle between the tangent to the anchor line and the mean plane of the anchor at the connecting point of the anchor line, as a function of the depth of the anchor (FIG. 3), a further sliding of the anchor or the stopping of this movement depends on the value of the above-described angle;
- the anchor shape which provides either for rapidly plunging, or rectilinear paths, or for anchoring paths tending asymptotically to follow a horizontal line.

FIG. 3 shows various positions of the anchor and of the anchor line for an anchor following a rectilinear path, up to the blocking and tearing out of the anchor. As apparent from the drawing, the anchor penetrates to a greater depth reaching the position (c') in the case of a clayish ground (i.e., $\Psi=0$).

Figure 4:
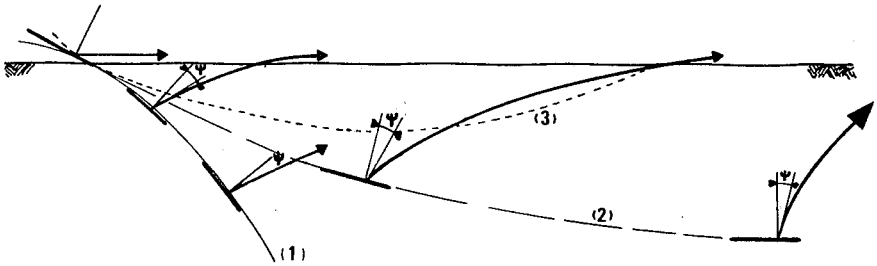

FIG. 4 shows three curvilinear paths, one of which has a horizontal asymptote. This shape permits the anchor to reach a kinematic equilibrium and to achieve anchoring with a constant dragging force.

Various shapes of anchors according to the invention have been studied. They all comprise at least one plate which may or may not be tapered to facilitate its penetration (FIGS. 5A through 10B).

For instance, FIGS. 5A, 5B, 6A and 6B show different embodiments of the invention having dual symmetrical leading edges, one showing the leading edges in the form of a sharp arrow, and the other in the form of a rectangle. The two embodiments also include stabilizing legs for maintaining an angle of inclination on both sides of the main plate. FIGS. 7A, 7B, 8A and 8B show still two other embodiments with stabilizing legs on only one side of the plate. The plate in each case being bent to ensure that the legs are always directed toward the bottom.

There may also be provided various surfaces having the shape of a reversed dihedron and/or of an arrow.

There may also be different parallel mean planes making up the legs, such as the wings of a biplane, with vertical or inclined guide surfaces forming wing flaps similar to the fins of a plane, so as to prevent unstable motion (FIGS. 9A and B, and 10A and B). In each case it is essential to select the position of the connecting point of the pulling line so as to give the optimum anchoring power to the device.

Various shapes may be used without departing from the scope of the invention, in the same way as kites may be given very different shapes while still deriving from the same concept. To tear out the anchor it is sufficient to exert an upward or backward pull on the anchor line, optionally by means of another cable secured at the rear portion of the anchor such as is shown in FIGS. 5A and 5B, so as to make the latter slide in the reverse direction.

These new anchors may be arranged in series or in parallel. An advantage of the series connection is that each anchor is drawn forward by the anchor line and held backward by the action of the following anchor.

Thus, this anchor is more easily put in line with the others for example, towards a horizontal line which has the advantage of increasing the angle between the perpendicular to the anchor and the tangent to the anchor line. Moreover, many anchors connected in series increase the anchoring power. When such anchors are connected in parallel they also add their resistance whether located in different planes, or in the same vertical plane.

The new anchors according to the invention provide for high anchoring powers, for example of many hundred tons when used at sea on a sandy water bottom, and this is achieved with an equipment of reduced bulkiness, for example a plate of 2 meters×3 meters.

We claim:

1. An anchoring system comprising:

an anchor having a profiled shape for permitting complete burying thereof, said anchor comprising at least one plate having a leading edge, and said plate adapted for being retained completely buried;

flexible connection means located on said plate for having a line attached thereto, and adapted for preventing transmission of any substantial moment of rotation to said anchor;

at least one anchor line connected to at least one point of said plate by means of said flexible connection means, said point of connection being located on said plate for causing any force exerted by means of said anchor line to be applied to said plate at a fixed position forward of the center of mass of the bearing surface of said plate in the direction of displacement of said plate through the ground during positioning thereof;

penetrating means operatively associated with said at least one plate for facilitating penetration of said plate into the ground when traction is exerted on said line; and inclination means secured to and below said plate for maintaining the leading edge of said plate, when located on the bottom surface, inclined toward the water bottom at an angle of no more than 30° with respect thereto, whereby said inclination means and penetrating means operatively combine with the weight of the plate to maintain the plate inclined at said angle.

2. An anchoring system comprising:

an anchor having a profiled shape for permitting complete burying thereof, said anchor comprising at least one plate having a leading edge, and said plate adapted for being retained completely buried;

flexible connection means located on said plate for having a line attached thereto, and adapted for preventing transmission of any substantial moment of rotation to said anchor;

at least one anchor line connected to at least one point of said plate by means of said flexible connection means, said point of connection being located on said plate at a point comprising between one third and one half the length of said plate from the leading edge thereof opposite to the direction of displacement for causing any force exerted by means of said anchor line to be applied to said plate at a fixed position forward of the center of mass of the bearing surface of said plate in the direction of displacement of said plate through the ground during positioning thereof;

penetrating means operatively associated with said at least one plate for facilitating penetration of said plate into the ground when traction is exerted on said line; and inclination means secured to and below said plate for maintaining the leading edge of said plate, when located on the bottom surface, inclined toward the water bottom at an angle of no more than 30° with respect thereto, whereby said inclination means and penetrating means operatively combine with the weight of the plate to maintain the plate inclined at said angle.

3. An anchoring system as in claim 1, wherein said anchor comprises a plate having a substantially rectangular shape.

4. An anchoring system as in claim 1, wherein said anchor comprises one plate having a triangular shape.

5. An anchoring system as in claim 1, wherein said anchor comprises at least one plate having a rectangular shape and further comprising an extension on said plate having a triangular shape with the tapered end thereof defining the leading edge of said plate.

6. An anchoring system as in claim 1, wherein said anchor comprises at least one rectangular shaped plate, with one smaller side having a v-shaped notch cut-out defining two tapered ends, and said tapered ends defining said leading edge.

7. An anchoring system as in claim 1, wherein said anchor comprises at least two plates connected in different planes whereby said connected plates are shaped like a dihedron.

8. An anchoring system as in claim 1, wherein said anchor further comprises two plates extending therefrom in parallel planes.

9. An anchoring system as in claim 1, wherein said anchor further comprises stabilizing means for stabilizing the orientation of said anchor during displacement through the ground.

10. An anchoring system as in claim 9, wherein said stabilizing means comprises stabilizing fins secured to said plate.

11. An anchoring system as in claim 1, wherein said anchor further comprises an extraction cable connected to the rear of said plate for facilitating weighing of the anchor.

* * * * *